US010637157B2

(12) United States Patent
Rashidian

(10) Patent No.: US 10,637,157 B2
(45) Date of Patent: Apr. 28, 2020

(54) ANTENNA ARRAYS WITH COMMON PHASE CENTERS

(71) Applicant: PERASO TECHNOLOGIES INC., Toronto (CA)

(72) Inventor: Atabak Rashidian, North York (CA)

(73) Assignee: PERASO TECHNOLOGIES INC., Toronto (CA)

( * ) Notice: Subject to any disclaimer, the term of this patent is extended or adjusted under 35 U.S.C. 154(b) by 92 days.

(21) Appl. No.: 15/367,388

(22) Filed: Dec. 2, 2016

(65) Prior Publication Data

US 2018/0159247 A1 Jun. 7, 2018

(51) Int. Cl.

| | |
|---|---|
| ***H01Q 21/20*** | (2006.01) |
| ***H01Q 21/06*** | (2006.01) |
| ***H01Q 21/00*** | (2006.01) |
| ***H01Q 1/52*** | (2006.01) |
| ***H01Q 19/17*** | (2006.01) |

(52) U.S. Cl.
CPC ..... *H01Q 21/065* (2013.01); *H01Q 1/525* (2013.01); *H01Q 19/17* (2013.01); *H01Q 21/0075* (2013.01); *H01Q 21/20* (2013.01)

(58) Field of Classification Search
CPC ..... H01Q 3/24; H01Q 1/243; H01Q 21/28; H01Q 13/02
USPC ..... 343/876, 753, 893, 778, 853
See application file for complete search history.

(56) References Cited

U.S. PATENT DOCUMENTS

| | | | | |
|---|---|---|---|---|
| 5,838,282 | A * | 11/1998 | Lalezari | H01Q 21/26 343/727 |
| 2003/0137456 | A1* | 7/2003 | Sreenivas | H01Q 1/38 343/700 MS |
| 2009/0009337 | A1* | 1/2009 | Rofougaran | G06K 7/10237 340/572.7 |
| 2015/0122886 | A1* | 5/2015 | Koch | G06K 7/10356 235/440 |
| 2016/0233588 | A1* | 8/2016 | Bily | H01Q 25/00 |

* cited by examiner

*Primary Examiner* — Graham P Smith
(74) *Attorney, Agent, or Firm* — Perry + Currier

(57) ABSTRACT

An antenna assembly includes: a support member having opposing first and second sides; an input electrical contact and an output electrical contact; a first array of transmission patch elements supported on the first side and connected to the input electrical contact, the first array configured to receive an input signal via the input electrical contact and generate outbound radiation according to the input signal; a second array of reception patch elements supported on the first side and connected to the output electrical contact, the second array configured to receive inbound radiation and generate an output signal at the output electrical contact according to the outbound radiation; the first array and the second array having a common phase center.

17 Claims, 9 Drawing Sheets

ANTENNA ARRAYS WITH COMMON PHASE CENTERS

FIELD

The specification relates generally to wireless communication, and specifically to antenna arrays with similar phase centers.

BACKGROUND

In certain wireless communication systems, reflectors are employed with antennas, with the antenna being referred to as a feed for the reflector, in order to increase transmission and reception gain over that provided by the antenna alone. Various design constraints impact the design of antennas for such applications. Such antennas may be required to achieve a certain beamwidth, for example a width sufficient to impact substantially the entire surface of the reflector. It may also be desirable to maximize the gain of the antenna itself. Further, it may be desirable to simplify manufacturing of the antenna, and also to reduce energy losses within the antenna. Existing antenna assemblies leave room for improvement in satisfying the above design constraints while also optimizing antenna performance for use with a reflector.

SUMMARY

According to an aspect of the specification, an antenna assembly is provided, comprising: a support member having opposing first and second sides; an input electrical contact and an output electrical contact; a first array of transmission patch elements supported on the first side and connected to the input electrical contact, the first array configured to receive an input signal via the input electrical contact and generate outbound radiation according to the input signal; and a second array of reception patch elements supported on the first side and connected to the output electrical contact, the second array configured to receive inbound radiation and generate an output signal at the output electrical contact according to the inbound radiation; the first array and the second array having a common phase center.

According to another aspect of the specification, a wireless communications assembly is provided, comprising: an assembly support member defining a mounting surface including a transmission electrical contact and a reception electrical contact; a radio processor carried on the assembly support member and connected to the transmission electrical contact and a reception electrical contact; and the antenna assembly of the above-mentioned aspect, the support member coupled to the mounting surface to electrically connect the output electrical contact with the reception electrical contact and the input electrical contact with the transmission electrical contact.

According to a further aspect of the specification, a communications system is provided, comprising: a parabolic reflector having a focal point; and a wireless communications assembly according to the above-mentioned aspect, supported to position the common phase center of the first array of transmission patch elements and the second array of reception patch elements at the focal point.

BRIEF DESCRIPTIONS OF THE DRAWINGS

Embodiments are described with reference to the following figures, in which.

DETAILED DESCRIPTION OF THE EMBODIMENTS

Figure 1A:
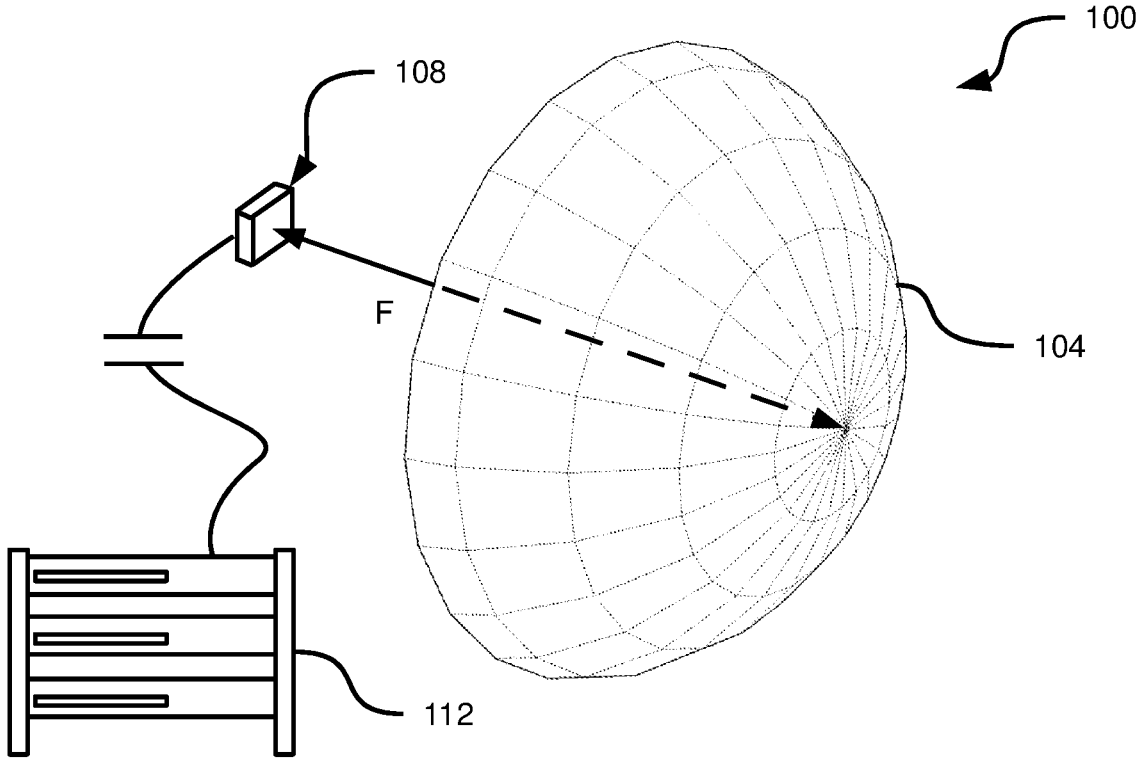
FIGS. 1A and 1B depict perspective and top plan views of a wireless communications system, respectively, according to a non-limiting embodiment.

FIG. 1A depicts a communications system including a parabolic reflector 104, a wireless communications assembly 108, and a computing device 112. In the present embodiment, wireless communications assembly 108 is configured to enable communication using the IEEE 802.11ad standard, and thus transmit and receive data are around 60 GHz. In other embodiments, however, assembly 108 is configured to enable wireless communications in other frequency bands.

Assembly 108 includes an antenna assembly, which will be discussed in greater detail below, directed towards the concave surface of reflector 104. Assembly 108 acts as a feed for reflector 104 by receiving data for transmission from computing device 112, and emitting radiation through excitation of the antenna towards reflector 104. As will now be apparent, the radiation is aligned and directed by reflector 104. Assembly 108 also receives incoming radiation that impacts reflector 104 and is focussed by reflector 104 onto the antenna. The incoming radiation is detected by the antenna and the data encoded therein is provided by assembly 108 to computing device 112.

Computing device 112 may be any of a wide variety of computing devices. Typically, systems employing reflectors such as reflector 104 are deployed as high-gain backhaul links, and thus computing device 112 is illustrated as a data center which may, for example, enable communications between wireless devices and the Internet. This implementation is provided simply as an illustrative example, however—a wide variety of computing devices may be employed with system 100, and system 100 may be deployed in any scenario requiring wireless communications (e.g. with other similar systems, with mobile devices such as smartphones, laptop computers and the like, or a combination thereof).

Figure 1B:
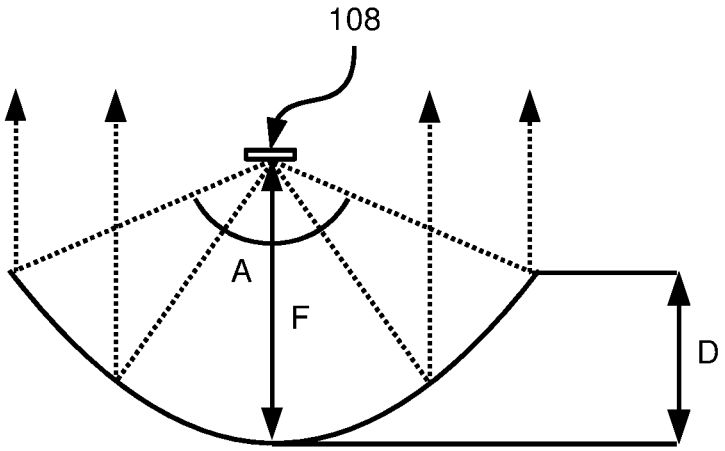

As seen in FIG. 1A and FIG. 1B, which depicts a top plan view of system 100 (omitting computing device 112), reflector 100 is a parabolic reflector with predetermined depth "D" and focal length "F". As illustrated by FIG. 1B, radiation generated by the antenna of assembly 108 is aligned by reflector 104. Incoming radiation is directed by reflector 104 towards the focal point, which is located along the axis of symmetry of reflector 104 at the distance F from the reflector's vertex. Assembly 108 is therefore supported (via any suitable support structure, not shown) relative to reflector 104 so as to locate the antenna at the focal point of reflector 104.

The antenna has a beamwidth angle "A", shown in FIG. 1B, indicating the angle at which the antenna is capable of emitting radiation or receiving radiation at or above a predefined level of the antenna's maximum power or sensitivity (e.g. −10 dB relative to maximum). For example, the beamwidth angle A shown in FIG. 1B is about 100 degrees. Before discussing the features of the antenna that contribute to the beamwidth and other performance characteristics of the antenna, certain other components of assembly 108 will be described with reference to FIGS. 2A, 2B and 2C.

Figure 2A:
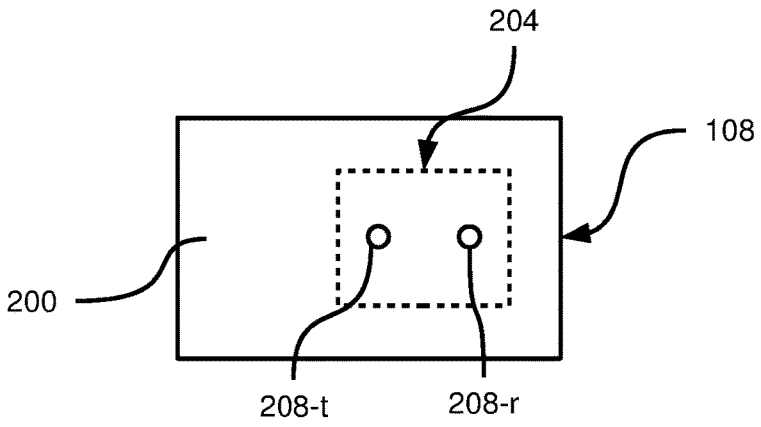
FIGS. 2A and 2B depict top plan views of a wireless communications assembly of the system of FIG. 1A, according to a non-limiting embodiment.
Figure 2B:
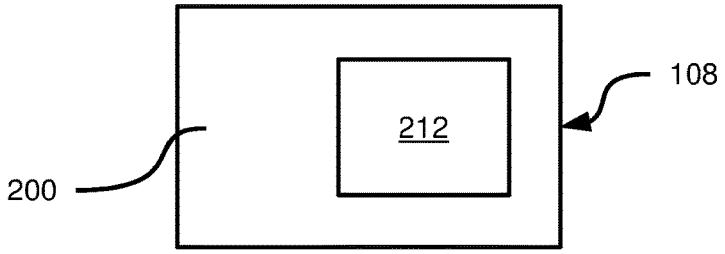

FIG. 2A illustrates a top view of assembly 108 ("top" as employed herein, refers to the direction facing reflector 104 when assembly 108 is installed as shown in FIGS. 1A and 1B). As seen in FIG. 2A, assembly 108 includes an assembly support member 200, which in the present embodiment includes a printed circuit board (PCB). Assembly support member 200 defines a mounting surface 204 thereon (specifically, on the upper side thereof, being the side configured to face reflector 104). Assembly support member 200 also includes a transmission electrical contact 208-*t* and a reception electrical contact 208-*r*. Mounting surface 204 is configured to receive an antenna assembly 212, as shown in FIG. 2B, and in doing so orient antenna assembly 212 to electrically connect contacts 208 with corresponding contacts on antenna assembly. Specifically, reception contact 208-*r* is connected with an output contact of antenna assembly 212, while transmission contact 208-*t* is connected with an input contact of antenna assembly 212. The contacts of antenna assembly 212 will be discussed further below.

The mechanism by which antenna assembly 212 is mounted to mounting surface 204 is not particularly limited. Mounting surface 204 includes any suitable surface-mount packaging, such as a ball grid array (BGA), to couple antenna assembly 212 to assembly support member 200 and place contacts 208-*t* and 208-*r* with the corresponding electrical contacts of antenna assembly 212.

Figure 2C:
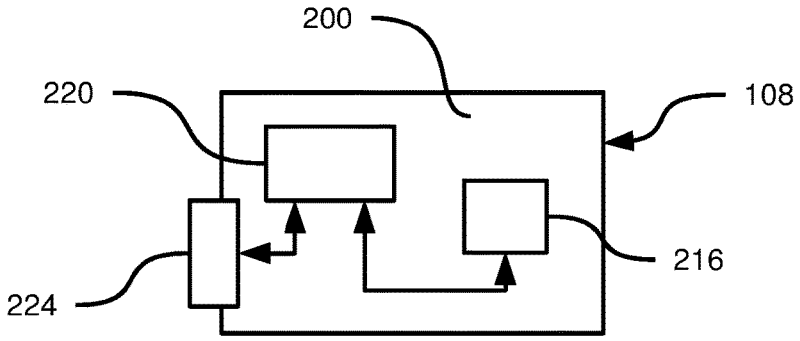
FIG. 2C depicts a bottom plan view of the wireless communications assembly of FIG. 2A, according to a non-limiting embodiment.

FIG. 2C illustrates a bottom view (that is, a view of the side opposite from that shown in FIGS. 2A and 2B) of assembly 108. As seen in FIG. 2C, assembly 108 includes a radio processor 216 carried on assembly support member 200 (e.g. connected to assembly support member 200 via BGA or other surface mount structure). Radio processor 216 receives incoming signals from antenna assembly 212 and transmits the processed incoming signals to a baseband processor 220, also carried on assembly support member 200. Radio processor 216 and baseband processor 220, as will be apparent to those skilled in the art, each include one or more integrated circuits, and can be selected from any of a variety of conventional radio and baseband processors.

Radio processor 216 also receives outgoing signals from baseband processor 220 and applies the outgoing signals to antenna assembly 212 for transmission. Thus, radio processor 216 is electrically connected to electrical contacts 208 on the opposite side of assembly support member 200, by any suitable combination of vias and traces supported by assembly support member 200.

Baseband processor 220, in turn, is connected to a communications interface 224 carried by assembly support member 200. Communications interface 224 is any suitable communications interface, such as a Universal Serial Bus (USB) interface, an Ethernet interface or the like. Via communications interface 224, baseband processor 220 receives data from computing device 112 for transmission via radio processor 216 and antenna assembly 212. Baseband processor 220 also receives and processes incoming transmissions via antenna assembly 212 and radio processor 216, and transmits the incoming data to computing device 112 via communications interface 224.

Figure 3A:
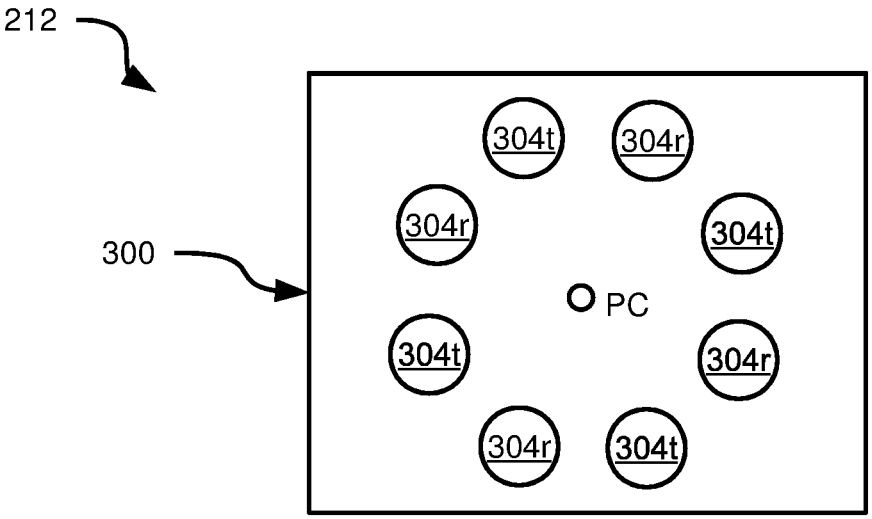
FIGS. 3A and 3B depict top and bottom plan views respectively of an antenna assembly of the wireless communications assembly of FIG. 2A, according to a non-limiting embodiment.

Having described certain components of assembly 108, the features of antenna assembly 212 will now be described in greater detail. Referring to FIG. 3A, antenna assembly includes a support member 300 (such as a PCB). FIG. 3A illustrates a first side of support member 300 (which may also be referred to as the top or upper side, in that it faces reflector 104 when antenna assembly is installed) is depicted.

Supported on the first side of support member 300 are a plurality of patch antenna elements, which in the present embodiment are circular patches. In particular, a first phased array of transmission patch elements 304*t*, and a second phased array of reception patch elements 304*r* are supported on the first side of support member 300. The patch elements 304 may be etched from a layer of conductive material of support member 300, deposited as conductive material (e.g. copper, silver and the like) on support member 300, or manufactured by any other suitable process.

Each transmission patch element 304*t* is supported on support member 300 at a predefined distance from a central location on the first side of support member, labelled "PC" (the point PC does not necessarily have any particular structural feature, circuit element or the like). That is, the transmission patch elements 304*t* are disposed in a circular arrangement having PC as its center. Further, the transmission patch elements 304*t* are arranged such that the set of vectors extending from the point PC to respective transmission patch elements 304*t* sum to zero. That is, for the four transmission patch elements 304*t* shown in FIG. 3A, the four vectors extending from PC to those patch elements sum to zero. More specifically, in the present embodiment, this is achieved by placing the transmission patch elements 304*t* in symmetrical pairs about the point PC. Positioning the transmission patch elements 304*t* as described above places the phase center of the phased array of transmission patch elements 304*t* at the point PC.

Similarly, each reception patch element 304*r* is supported on support member 300 at a predefined distance from the point PC. That is, the reception patch elements 304*r* are disposed in a circular arrangement having PC as its center. Further, the reception patch elements 304*r* are arranged such that the set of vectors extending from the point PC to respective reception patch elements 304*r* sum to zero. That is, for the four reception patch elements 304*r* shown in FIG. 3A, the four vectors extending from PC to those patch elements sum to zero. More specifically, in the present embodiment, this is achieved by placing the reception patch elements 304*r* in symmetrical pairs about the point PC. Positioning the receptions patch elements 304*r* as described above places the phase center of the phased array of reception patch elements 304*r* at the point PC.

As will now be apparent from the above, the arrays of transmission and reception patch elements have a common phase center at the point PC as a result of their arrangements on support member 300. Various arrangements of the transmission and reception patch elements other than that shown in FIG. 3A are contemplated which achieve a common phase center for both transmission and reception. In the present embodiment, the predefined distance (i.e. the radius of the above-mentioned circular arrangements) is the same for both transmission patch elements 304*t* and reception patch elements 304*r*. In addition, in the present embodiment the transmission and reception patch elements 304*t* and 304*r* are placed in an alternating arrangement on support member 300 (i.e. each transmission patch element 304*t* is placed between two reception patch elements 304*r*).

Figure 3B:
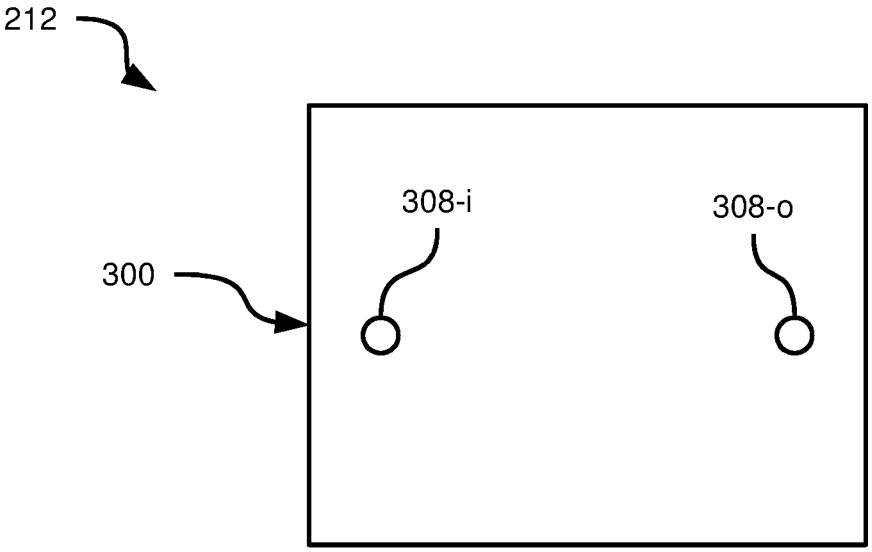

Turning to FIG. 3B, a second side of support member 300 is illustrated, opposite the first side shown in FIG. 3A. That is, the side of support member 300 illustrated in FIG. 3B is referred to as the bottom or lower layer, due to its orientation away from reflector 104 when antenna assembly 212 is installed.

As seen in FIG. 3B, antenna assembly 212 includes an input electrical contact 308-*i* and an output electrical contact 308-*o*. Input contact 308-*i* is connected to the first array of transmission patch elements 304*t*, and transmission patch elements 304*t* are thus configured to receive an input signal via input contact 308-*i* and generate outbound radiation according to the input signal. As will now be apparent, the input signal is applied to input contact 308-*i* by radio processor 216 via transmission contact 208-*t*.

Meanwhile, output contact 308-*o* is connected to the second array of reception patch elements 304*r*, and reception patch elements 304*r* are thus configured to receive inbound radiation and generate an output signal at output contact 308-*o* according to the inbound radiation. As will now be apparent, the output signal generated at output contact 308-*o* is transmitted to radio processor 216 via reception contact 208-*r*.

Figure 4:
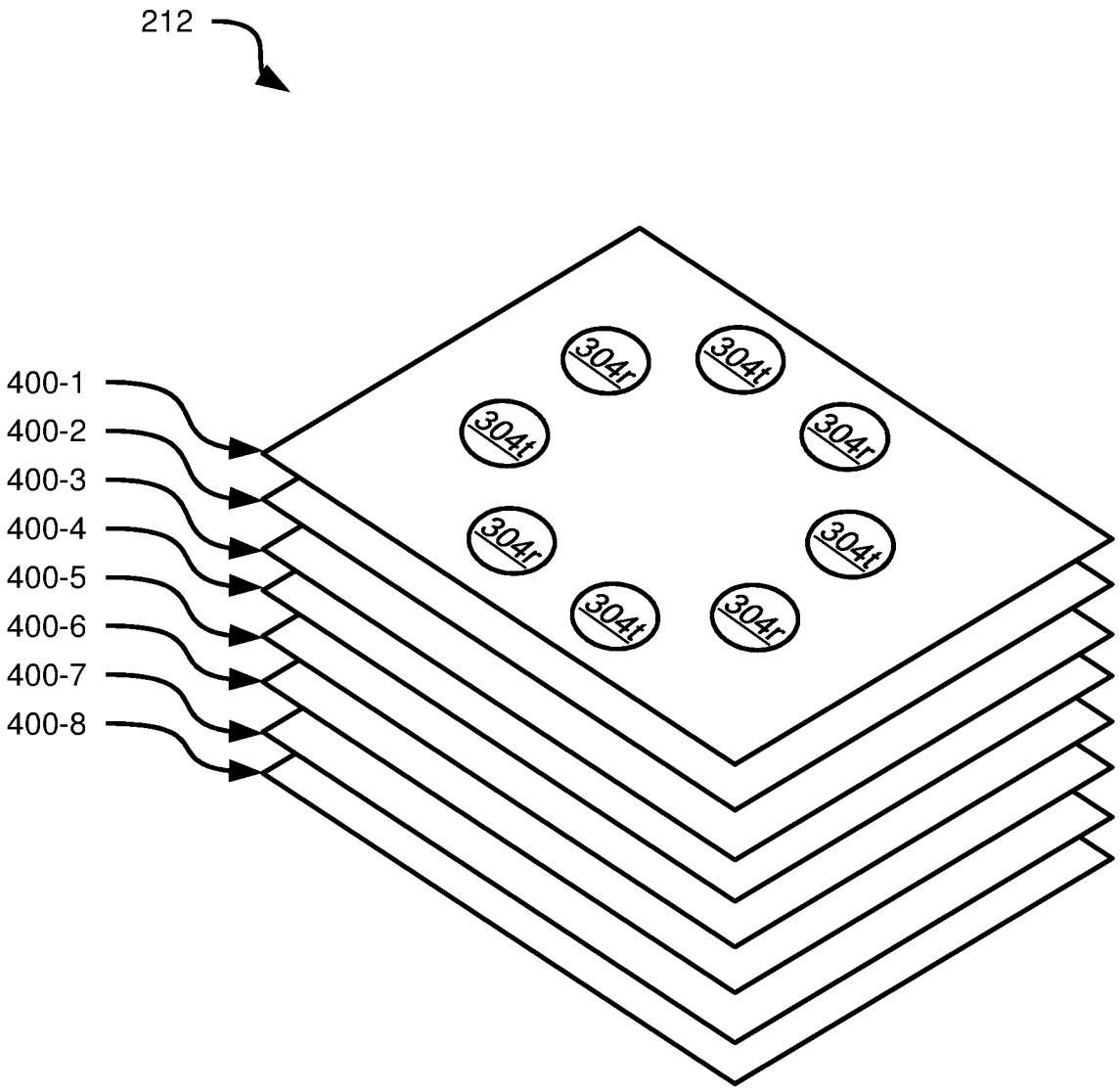
FIG. 4 depicts the layered structure of the antenna assembly of FIG. 3A, according to a non-limiting embodiment

Antenna assembly 212, in some embodiments, includes additional structural features associated with the connections between contacts 308-*i* and 308-*o* and the corresponding arrays of patch elements. Turning to FIG. 4, antenna assembly 212 is illustrated with a substrate material (e.g. a dieletric material) of support member 300 omitted, revealing a plurality of conductive layers (e.g. of copper or silver). Each conductive layer includes various features, manufactured by etching, deposition, or the like. The spacing between conductive layers is exaggerated in FIG. 4 for illustrative purposes.

More specifically, in the present embodiment, support member 300 includes eight conductive layers 400-1, 400-2, 400-3, 400-4, 400-5, 400-6, 400-7 and 400-8. Layer 400-1 carries patch elements 304, as described above, while layer 400-8 carries contacts 308-*i* and 308-*o*. The conductive layers between layer 400-1 and 400-8 carry various other features, to be discussed below.

Figure 5:
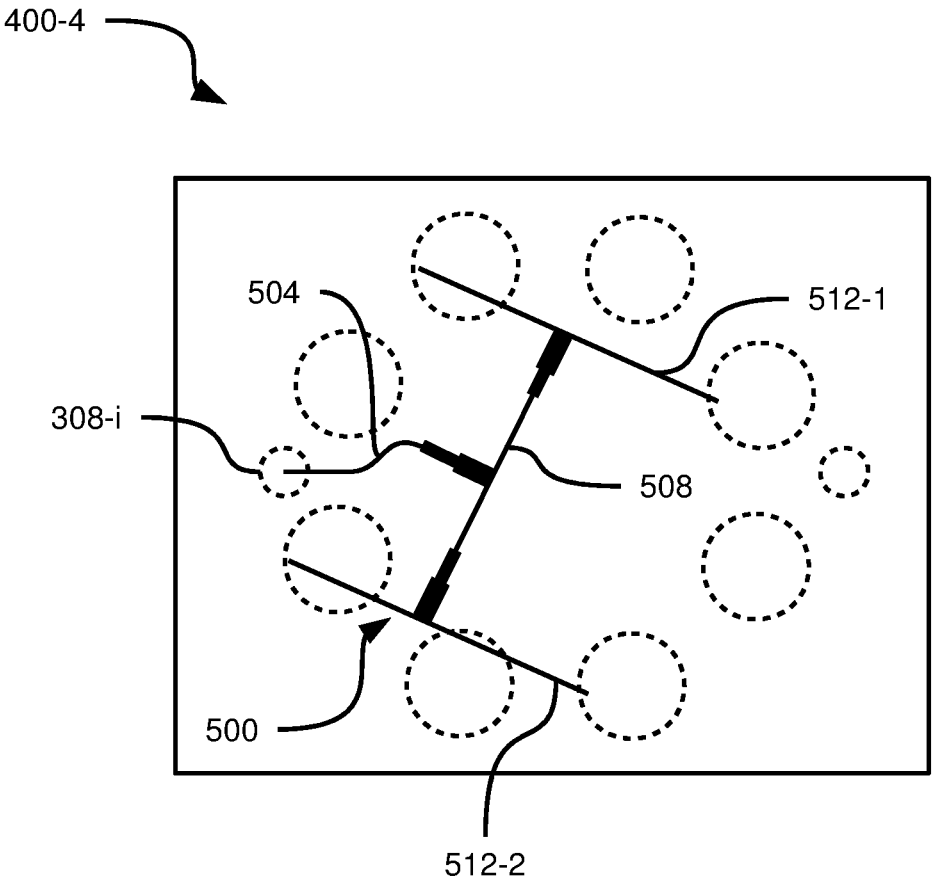
FIG. 5 depicts a transmission feed network of the antenna assembly of FIG. 4, according to a non-limiting embodiment.

A conductive layer 400 between the first and second sides of support member 300—layer 400-4, in the present embodiment, illustrated in FIG. 5—supports a first feed network 500 configured to interconnect the first array of transmission patch elements 304*t* with input electrical contact 308-*i*. Contact 308-*i* and patch elements 304 are shown in FIG. 5 in dashed lines for illustrative purposes, but it will be understood that those elements are not present on layer 400-4.

Feed network 500 includes a primary feed line 504 travelling from a via connecting to input contact 308-*i* to a secondary feed line 508; secondary feed line 508 splits the signal from primary feed line 504 towards two terminal feed lines 512-1, 512-2, each of which further splits the signal between a pair of transmission patch elements 304*t* (terminal feed lines 512 are connected to intermediate patch elements, to be described in greater detail below, by additional vias). As also seen in FIG. 5, primary feed line 504 and secondary feed line 508 each include wider traces in regions approaching the downstream feed line. Thus, primary feed line 504 includes two successive increases in width as it approaches secondary feed line 508, and secondary feed line 508 includes two successive increases in width as it approaches terminal feed lines 512.

Figure 6:
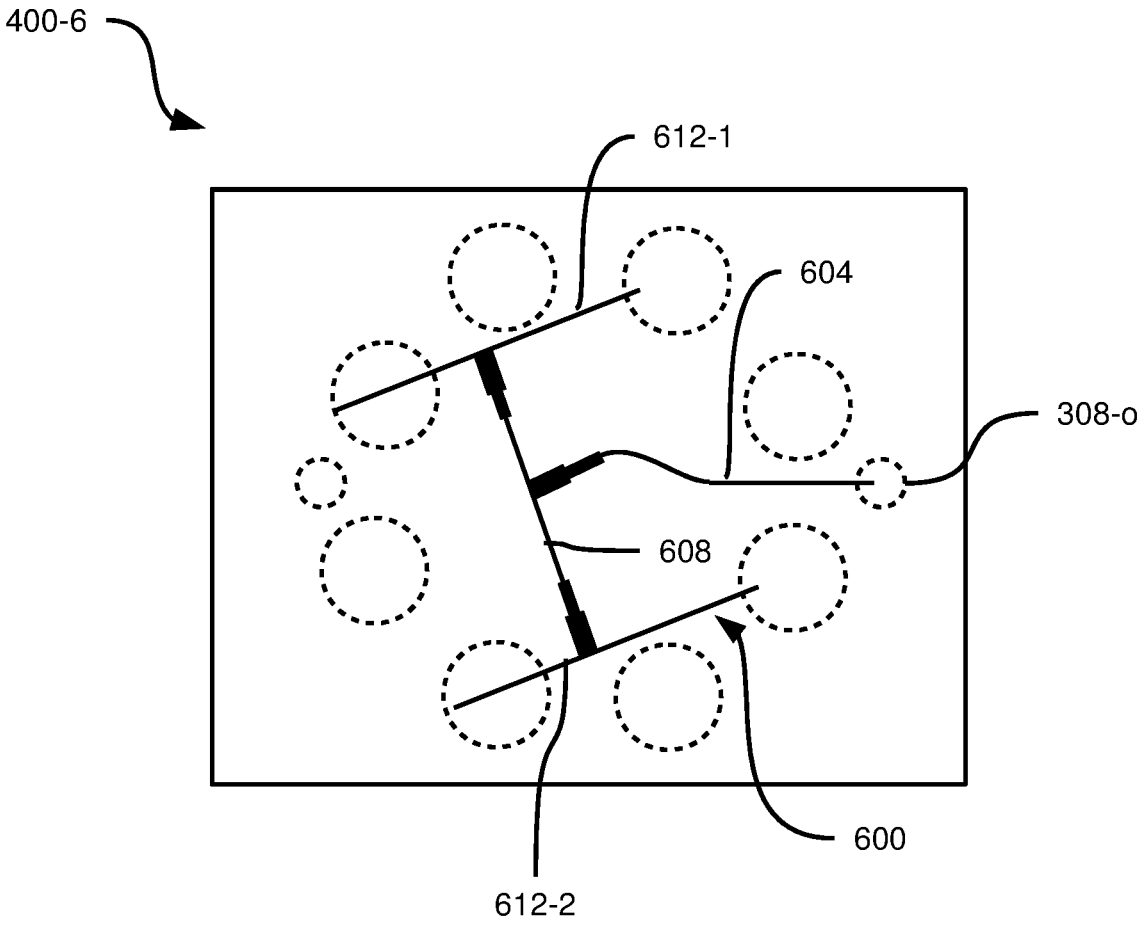
FIG. 6 depicts a reception feed network of the antenna assembly of FIG. 4, according to a non-limiting embodiment.

An additional conductive layer 400 between layer 400-4 (that is, the layer carrying first feed network 500) and layer 400-8—layer 400-6, in the present embodiment, illustrated in FIG. 6—supports a second feed network 600 configured to interconnect the second array of reception patch elements 304*r* with output electrical contact 308-*o*. Contact 308-*o* and patch elements 304 are shown in FIG. 6 in dashed lines for illustrative purposes, but it will be understood that those elements are not present on layer 400-6.

Feed network 600 includes a primary feed line 604 travelling from a via connecting to input contact 308-*o* to a secondary feed line 608; secondary feed line 608 splits the signal from primary feed line 604 towards two terminal feed lines 612-1, 612-2, each of which further splits the signal between a pair of reception patch elements 304*r* (terminal feed lines 612 are connected to intermediate patch elements, to be described in greater detail below, by additional vias). As also seen in FIG. 6, primary feed line 604 and secondary feed line 608 each include wider traces in regions approaching the downstream feed line. Thus, primary feed line 604 includes two successive increases in width as it approaches secondary feed line 608, and secondary feed line 608 includes two successive increases in width as it approaches terminal feed lines 612.

In other embodiments, a wide variety of other feed network structures can be implemented, with different combinations of primary, secondary and terminal feed lines (as well as additional levels of feed lines if greater numbers of patch elements are employed). Further, the above-mentioned wider traces can be omitted in some embodiments. In addition, in other embodiments the elevation of feed networks 500 and 600 can be reversed (that is, feed network 500 can be placed closer to layer 400-8 than feed network 600).

In addition to feed networks 500 and 600 being carried on different conductive layers 400, support member 300 can include an additional conductive layer in between the layers carrying feed networks 500 and 600, implemented as a ground plane. Thus, in the present embodiment, referring again to FIG. 4, layer 400-5 is a ground plane layer. An additional ground plane is also provided in the present embodiment, at layer 400-7 (i.e. between feed network 600 and layer 400-8).

Figure 7:
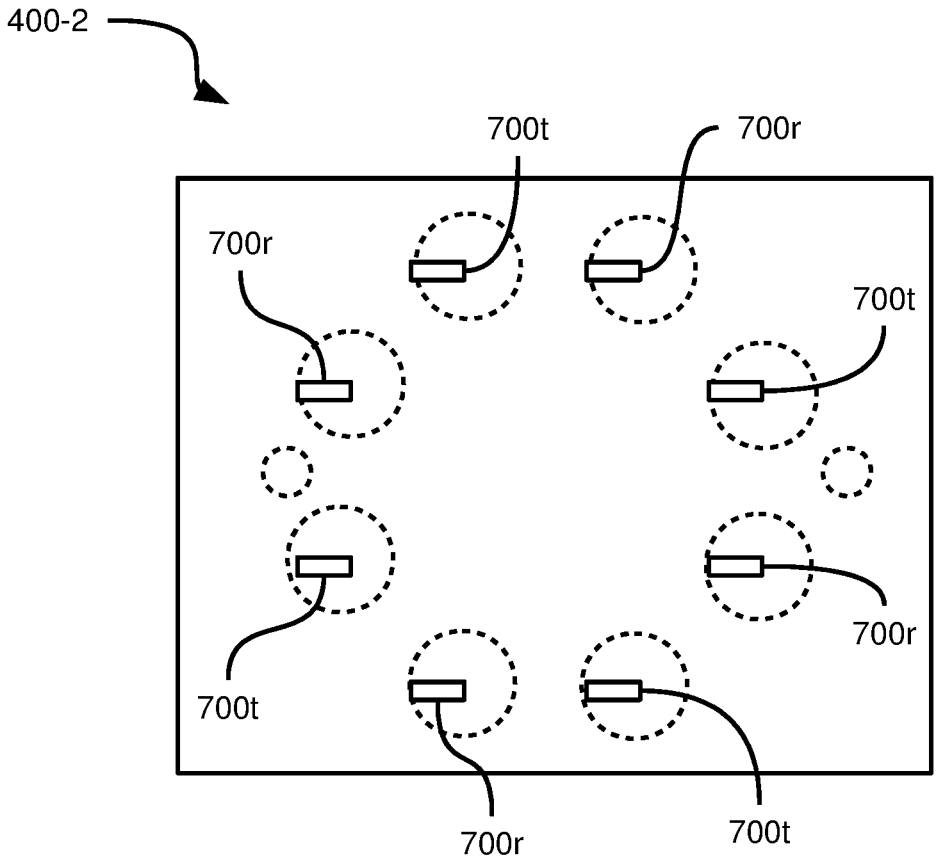
FIG. 7 depicts a set of intermediate patches of the antenna assembly of FIG. 4, according to a non-limiting embodiment.

Further, in the present embodiment an additional conductive layer is provided between layer 400-1 (i.e. the layer supporting patch elements 304) and layer 400-4 (i.e. the layer supporting feed network 500). Turning to FIG. 7, layer 400-2 is illustrated in greater detail. Layer 400-2 carries a first plurality of intermediate patches 700*t*, configured to connect to feed network 500 and couple the electromagnetic energy from feed network 500 toward the array of transmission patch elements 304*t*. Layer 400-2 also carries a second plurality of intermediate patches 700*r*, configured to connect to feed network 600 and couple the electromagnetic energy from the array of reception patch elements 304*r* to feed network 600. As will now be apparent, additional vias are provided to extend between the appropriate layers to connect feed networks 500 and 600 with intermediate patches 700*t* and 700*r*, respectively. No direct electrical connections are provided between intermediate patches 700 and patch elements 304.

In other embodiments, the intermediate patches 700 can be omitted. When the intermediate patches 700 are omitted, direct electrical connections between feed networks 500 and 600 are patch elements 304 can be provided. In further embodiments, intermediate patches 700 have the same shape and size as patch elements 304. In still further embodiments, a plurality of vertically-arranged intermediate patches are provided, with the bottom intermediate patch being electrically connected to the relevant feed network, and the remaining intermediate patches being electromagnetically coupled with each other and with the corresponding patch element 304.

Returning to FIG. 4, layers 400-2 and 400-4 (that is, intermediate patch elements 700 and feed network 500) can be separated by another ground plane at layer 400-3. As will now be apparent to those skilled in the art, a variety of stack-up designs for support member 300 may be implemented to provide the antenna features set out above. Further, in some embodiments additional non-conductive material may be placed over layer 400-1, to provide protection from the elements to patch elements 304. For example, the protective coating may be implemented by placing an additional layer of substrate material (without any conductive material supported thereon) above layer 400-1.

As noted earlier, layer 400-8 carries contacts 308-*i* and 308-*o*, for example in signal pads. Support member 300 also includes a plurality of ground pads on layer 400-8, not shown for simplicity of illustration. The ground pads, as well as associated vias, interconnect the ground planes (e.g. layers 400-3, 400-5, 400-7) and connect to corresponding ground structures on assembly support member 108.

Variations to the structure of antenna assembly 212 are contemplated. For example, in some embodiments the transmission patch elements 304*t* are placed at a different predetermined distance from the point PC than the reception patch elements 304*r*. In further embodiments, the patch elements have non-circular shapes (e.g. rectangular shapes). In still further embodiments, a different number of transmission patch elements 304*t* is provided than of reception patch elements 304*r*.

Figure 8A:
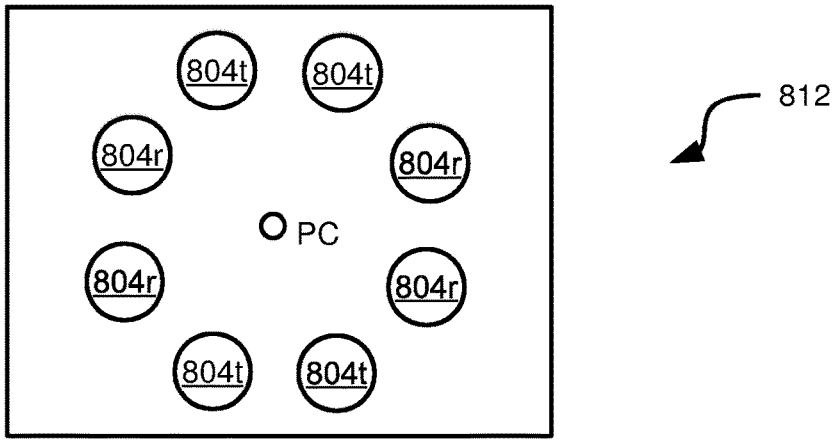
FIGS. 8A, 8B and 8C depict alternative antenna patch arrangements, according to additional non-limiting embodiments.
Figure 8B:
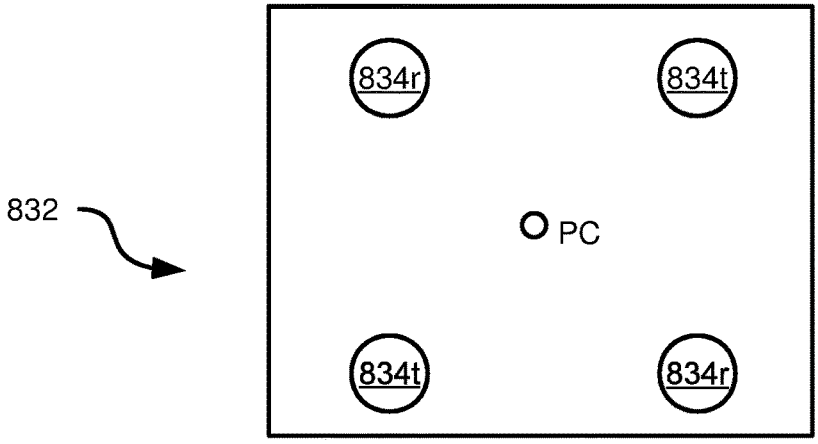
Figure 8C:
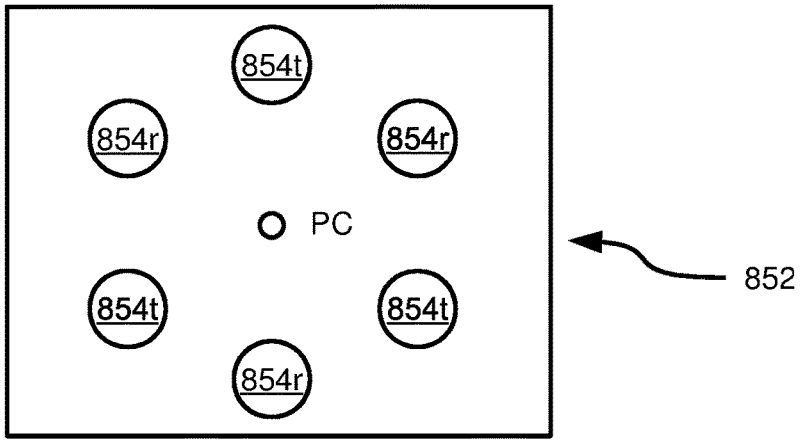

In still further embodiments, the arrangement of the transmission and reception patches is other than in symmetrical pairs, and need not place the patches in the alternating arrangement shown in FIG. 3A. For example, FIGS. 8A, 8B and 8C depict additional variations of patch arrangements. FIG. 8A, in particular, depicts an antenna assembly 812 in which four transmission patch elements 804*t* and four reception patch elements 804 are provided. However, in contrast to the arrangement of FIG. 3A, transmission and reception patch elements 804 do not alternate, but instead are placed in adjacent pairs. FIG. 8B depicts another embodiment in which an antenna assembly 832 supports two transmission patch elements 834*t* and two reception patch elements 834*r* arranged as the corners of a square centered on the point PC. FIG. 8C depicts a further embodiment in which an antenna assembly 852 supports three transmission patch elements 854*t* and three reception patch elements 854*r* arranged as the vertices of equilateral triangles about the point PC.

Certain advantages to the antenna structures discussed above will now occur to those skilled in the art. For example, the implementation of arrays of patches for each of transmission and reception reduces or eliminates the need for switch mechanisms necessary in antennae with only one radiating element. Further, the placement of the above-mentioned arrays according to the teachings herein permits such arrays to be implemented with common phase centers suitable for use with reflectors. As a further example, the isolated feed networks for the transmission and reception arrays may reduce interference (e.g. mutual coupling between the transmission and reception feed networks), particularly in compact antenna assemblies that may be required to achieve required beamwidths (e.g. around 90 to 100 degrees of −10 dB beamwidth).

Figure 9A:
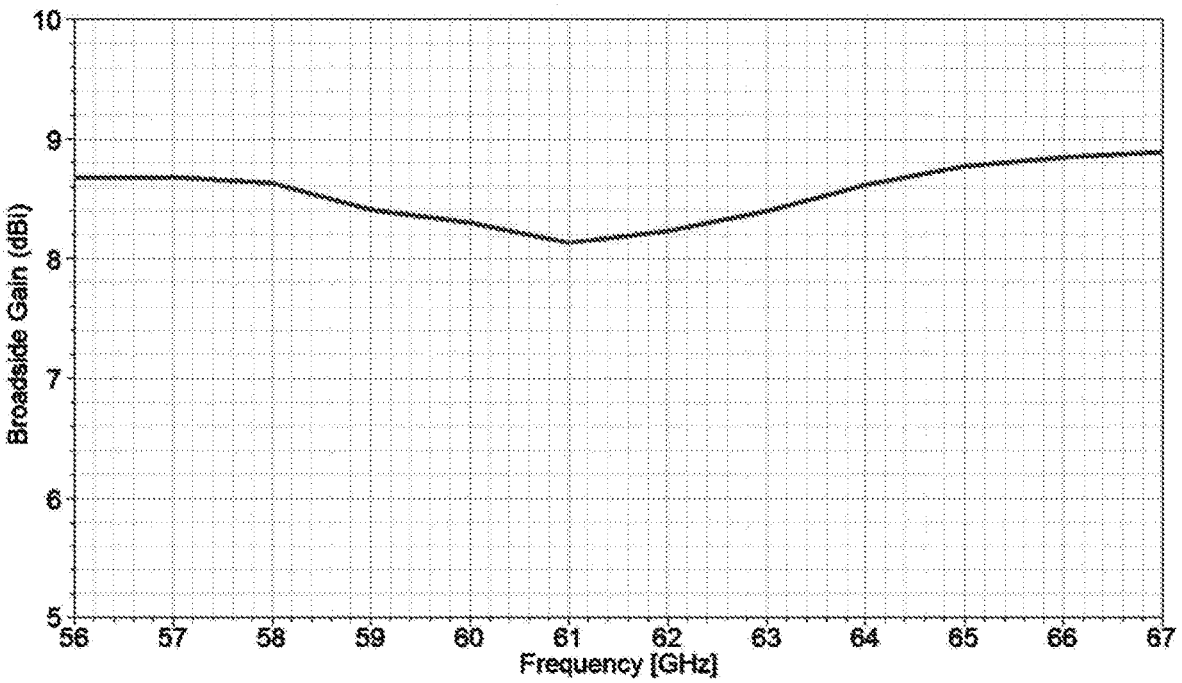
FIGS. 9A and 9B depict performance testing results of an example implementation of the system of FIG. 1A for 60 GHz WiGig applications, according to a non-limiting embodiment.
Figure 9B:
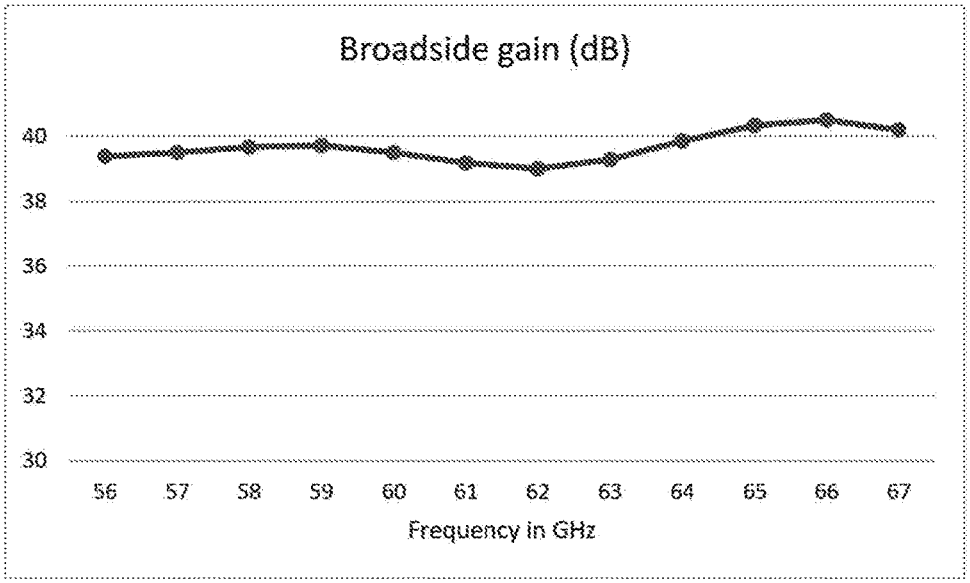

FIGS. 9A and 9B depict testing results for an example embodiment of a WiGig wireless communications assembly (i.e. based on the IEEE 802.11ad standard) as described above. The tested assembly employed a reflector with a depth of about 305 mm and a focal length of about 167 mm. An antenna assembly was employed having a support member with a length of 7.5 mm, a width of 6.5 mm, and a thickness of 0.949 mm and carrying arrays of transmission and reception patches as shown in FIG. 3A. The patches were electromagnetically coupled to feed networks structured as shown in FIGS. 5 and 6 by intermediate patches as shown in FIG. 7. The dimensions of the various features in the tested assembly were as shown in Table 1 below:

TABLE 1

Example Antenna Feature Dimensions

| Feature | Dimensions |
|---|---|
| Transmission/reception patches | 820 μm in diameter |
| Intermediate patches | 100 μm × 300 μm |
| Feed line (minimum width) | 50 μm in width |
| Feed line (intermediate width) | 100 μm |
| Feed line (greatest width) | 155 μm |
| Vias | 80 μm in diameter |
| Pads | 100 μm in diameter |
| Input/Output contact pads | 250 μm in diameter |
| Substrate | 7.5 × 6.5 mm |
| Substrate thickness | 949 μm |

FIG. 9A depicts the gain of the test antenna alone (i.e. without the reflector) at frequencies in the 60 GHz band, while FIG. 9B depicts the realized gain of the system at the broadside direction (i.e. the antenna acting as a feed for the reflector) at the same frequencies.

The scope of the claims should not be limited by the embodiments set forth in the above examples, but should be given the broadest interpretation consistent with the description as a whole.

The invention claimed is:

1. An antenna assembly, comprising:

a support member having opposing first and second sides;

an input electrical contact and an output electrical contact;

a first array of transmission patch elements, each transmission patch element of the first array supported at a predefined distance from a central location on the first side and connected to the input electrical contact, the first array configured to receive an input signal via the input electrical contact and generate outbound radiation according to the input signal; and a second array of reception patch elements distinct from the first array, each reception patch element of the second array being supported at the predefined distance from the central location on the first side and connected to the output electrical contact, the second array configured to receive inbound radiation and generate an output signal at the output electrical contact according to the inbound radiation;

the first array and the second array having a common phase center at the central location.

2. The antenna assembly of claim 1, the transmission patch elements supported in an alternating arrangement with the reception patch elements on the first side.

3. The antenna assembly of claim 2, the first array comprising four transmission patch elements, and the second array comprising four reception patch elements.

4. The antenna assembly of claim 1, each of the transmission patch elements and the reception patch elements being a circular patch element.

5. The antenna assembly of claim 1, further comprising:

a protective coating applied over the first array and the second array.

6. The antenna assembly of claim 1, the input electrical contact and the output electrical contact being supported on the second side.

7. The antenna assembly of claim 6, further comprising:

a first conductive layer of the support member between the first side and the second side, the first conductive layer supporting a first feed network configured to electromagnetically couple the first array and the input electrical contact.

8. The antenna assembly of claim 7, the first feed network comprising a feed line having a variable width.

9. The antenna assembly of claim 7, further comprising:

a second conductive layer of the support member between the first conductive layer and the second side, the second conductive layer supporting a second feed network configured to electromagnetically couple the second array and the input electrical contact.

10. The antenna assembly of claim 9, the second feed network comprising a feed line having a variable width.

11. The antenna assembly of claim 9, the support member further having a ground plane disposed between the first conductive layer and the second conductive layer.

12. The antenna assembly of claim 9, the support member further having an intermediate conductive layer between the first side and the first conductive layer, the intermediate conductive layer supporting:

a first plurality of intermediate patches connected to the first feed network and configured to electromagnetically couple with the first array; and a second plurality of intermediate patches connected to the second feed network and configured to electromagnetically couple with the second array.

13. A wireless communications assembly, comprising:

an assembly support member defining a mounting surface including a transmission electrical contact and a reception electrical contact;

a radio processor carried on the assembly support member and connected to the transmission electrical contact and a reception electrical contact; and an antenna assembly according to claim 1, the support member coupled to the mounting surface to electrically connect the output electrical contact with the reception electrical contact and the input electrical contact with the transmission electrical contact.

14. The wireless communications assembly of claim 13, further comprising:

a baseband processor carried by the assembly support member and connected with the radio processor.

15. The wireless communications assembly of claim 14, further comprising:

a communications interface carried by the assembly support member and connected with the baseband processor, for connecting the baseband processor with a computing device.

16. A communications system, comprising:

a parabolic reflector having a focal point; and a wireless communications assembly according to claim 15 supported to position the common phase center of the first array of transmission patch elements and the second array of reception patch elements at the focal point.

17. The communications system of claim 16, further comprising:

a computing device connected to the wireless communications assembly via the communications interface.

* * * * *